United States Patent [19]

Scoles

[11] 4,074,202

[45] Feb. 14, 1978

[54] BIASING CIRCUIT FOR THYRATRON

[75] Inventor: Graham John Scoles, Chelmsford, England

[73] Assignee: English Electric Valve Co., Ltd., Essex, England

[21] Appl. No.: 735,540

[22] Filed: Oct. 26, 1976

[30] Foreign Application Priority Data

Oct. 28, 1975 United Kingdom ..... 44515/75

[51] Int. Cl.[2] ..... H01J 17/44

[52] U.S. Cl. ..... 328/258; 328/251; 315/352

[58] Field of Search ..... 328/250, 251, 258; 315/350, 352, 355

[56] References Cited

U.S. PATENT DOCUMENTS

| | | | |
|---|---|---|---|
| 3,207,994 | 9/1965 | Theodore et al. | 328/258 |
| 3,311,784 | 3/1967 | Casanova | 315/352 |

*Primary Examiner*—John S. Heyman

*Attorney, Agent, or Firm*—Diller, Brown, Ramik & Wight

[57] ABSTRACT

A thyratron is provided with at least one pair of adjacent electrodes separating two voltage withstanding gaps. In order to reduce the likelihood of voltage breakdown occurring across one of the gaps that electrode of a pair of adjacent electrodes which is nearer to the anode of the thyratron is biased negatively relative to the other electrode of the pair.

17 Claims, 4 Drawing Figures

BIASING CIRCUIT FOR THYRATRON

Figure 1:
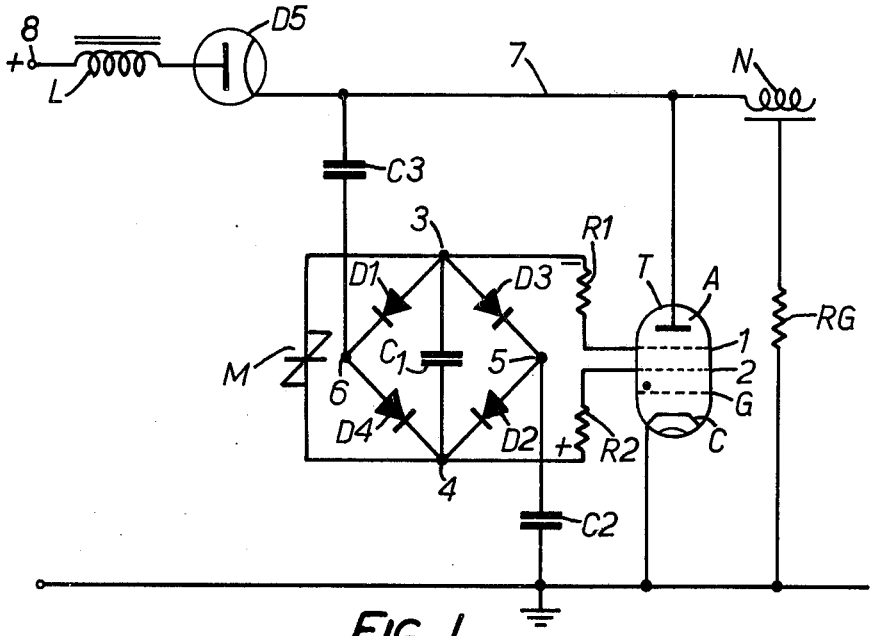

This invention relates to thyratron arrangements and in particular to arrangements including so called "multi-gap" thyratrons of the kind which comprise, between cathode and anode, at least one pair of adjacent electrodes separating two voltage withstanding gaps. Each pair of adjacent electrodes is normally referred to as a gradient-grid pair.

Commonly there are three voltage withstanding gaps between anode and cathode, the gap nearest the cathode being separated from the middle gap by one gradient-grid pair and the middle gap being in turn separated from the gap nearest the anode by a second gradient-grid pair. Normally a potential divider is connected across the thyratron in order to provide bias for the gradient-grid pairs so that each gradient-grid pair operates from a starting voltage which is progressively higher for gradient-grid pairs nearer the anode.

It has been found that multi-gap thyratrons tend to suffer from break down of one or more of the gaps at an undesirably low voltage. One object of the present invention is to provide an improved multi-gap thyratron arrangement in which this difficulty is reduced.

According to this invention a multi-gap thyratron arrangement comprises a thyratron having at least one gradient-grid pair consisting of two adjacent electrodes between the cathode and anode of said thyratron and means for biassing that electrode of said gradient-grid pair which is nearer the anode negatively with respect to the other electrode of said gradient-grid pair.

Where more than one gradient-grid pair is provided, preferably in each case means are provided for biassing that electrode of each gradient-grid pair which is nearer the anode negatively with respect to the other electrode of the same gradient-grid pair.

Preferably said means for biassing comprises a charge storage device connected between the two electrodes of a gradient-grid pair.

Preferably said charge storage device is a capacitor.

Preferably again means are provided for rectifying a current derived from the fluctuating voltage appearing in operation across said thyratron as a result of said thyratron firing, to provide a source of charging current for said charge storage device.

Preferably again said rectifier means comprises a rectifier bridge circuit.

In one embodiment of the invention a capacitor is connected across the output terminals of a quadrilateral rectifier bridge circuit, whilst the input terminals of said bridge circuit are connected each via a further capacitor to the anode and cathode respectively of said thyratron.

In another embodiment of the invention, four individual capacitors extend from a common point to the four terminals of a quadrilateral rectifier bridge circuit, the two output terminals being connected each to one of a pair of electrodes forming a gradient-grid pair and the two input terminals being connected via further capacitors one to the anode and the other to the cathode of said thyratron, and a connection is provided between said common point and the junction point of two voltage balancing resistors extending between said input terminals of said bridge.

Preferably the arrangement is such that the greater part of the current flowing in operation through a potential divider chain connected across said thyratron is applied to the input terminals of said rectifier bridge circuit in order to supplement the current flowing through said further capacitors to charge said charge storage device.

Preferably between each further capacitor and the respective corner of said rectifier bridge a resistor is provided.

In further embodiments of the invention said rectifier bridge circuits are provided in "split bridge" configuration.

Preferably in all cases across the charge storage device biassing that electrode of a gradient-grid pair which is nearer said anode negatively with respect to the other electrode of said gradient-grid pair, a voltage stabilising device is provided in order to limit the voltage to which said charge storage device may charge.

The invention is illustrated in and further described with reference to the accompanying drawings in which, FIGS. 1, 2, 3 and 4 illustrate various thyratron arrangements in accordance with the present invention.

In all Figures like references are used for like parts.

Referring to FIG. 1, a thyratron T is provided having a ceramic envelope within which is a cathode C and an anode A. Between cathode C and anode A is a control grid G and at least one gradient-grid pair consisting of two adjacent electrodes 1 and 2. With one gradient-grid pair as shown the thyratron is of the two gap type, the first voltage withstanding gap being between the control grid G and the electrode 2 of the gradient-grid pair and the second voltage withstanding gap being between the electrode 1 of the gradient-grid pair and the anode A. In practice, a potential divider is connected across the thyratron in order to provide suitable general biassing of the electrodes, but in FIG. 1 the potential divider is not shown.

Where further gradient-grid pairs are provided, each consisting of two adjacent electrodes like electrodes 1 and 2, the mean potential applied to each gradient-grid pair increases in progression towards the anode.

Electrode 1 is connected via a first resistor R1 to one end of a storage capacitor C1, the other end of which is connected via a resistor R2 to the electrode 2. Capacitor C1 is connected across the output terminals 3 and 4 of a quadrilateral rectifier bridge circuit consisting of four rectifier diodes D1, D2, D3 and D4, one in each arm of the bridge. Input terminal 5 of the bridge circuit, between rectifiers D3 and D2, is connected to common potential via a capacitor C2, whilst the remaining input terminal 6 of the bridge circuit, between diodes D1 and D4, is connected via a capacitor C3 to the thyratron anode rail 7. It will be noted that the rectifiers D1 to D4 are so poled that charge flowing in either direction in the series path containing capacitors C1, C2 and C3 always flows in the same direction into capacitor C1.

Connected in shunt across capacitor C1 is a voltage stabiliser, e.g. non-linear resistance material of the kind known as Metrosil, which holds the voltage to which capacitor C1 will charge to within predetermined limits. In place of Metrosil material, a zoner diode or a gas filled stabiliser or the like may be used.

Connected between a source of positive potential 8 and the thyratron anode rail 7 is the series combination of an inductance L and a diode D5. Connected between the anode and cathode rails of the thyratron T is a series connected circuit comprising a pulse forming network N and a resistance RG.

In effect, inductance L, diode D5, pulse forming network N, resistor RG and the thyratron T form a pulse generating circuit as known per se. With this arrangement the voltage across the thyratron T first rises co-sinusoidally from zero to a maximum and then, after a short delay, falls suddenly back to zero as the thyratron fires. Capacitors C3, C1 and C2 are effectively in series across thyratron T and, due to the action of the rectifier bridge D1 to D4, charge flowing in either direction causes C1 to charge cumulatively whilst the voltage fluctuation caused by the sequential firing of the thyratron T continues. The voltage stabiliser M limits the voltage to which capacitor C1 may charge to a value typically between 100 and 200 volts. Capacitor C1, therefore, provides a constant source of bias between the two electrodes 1 and 2 of the gradient-grid pair, which maintains electrode 1 more negative than electrode 2. This tends to prevent the passage of electrons into the space between electrode 1 and anode A as the plasma present in the space between the two electrodes 1 and 2 decays. It is such passage of electrons in prior arrangements which, it is believed, tended to cause the gap to break down at a relatively low voltage.

Figure 2:
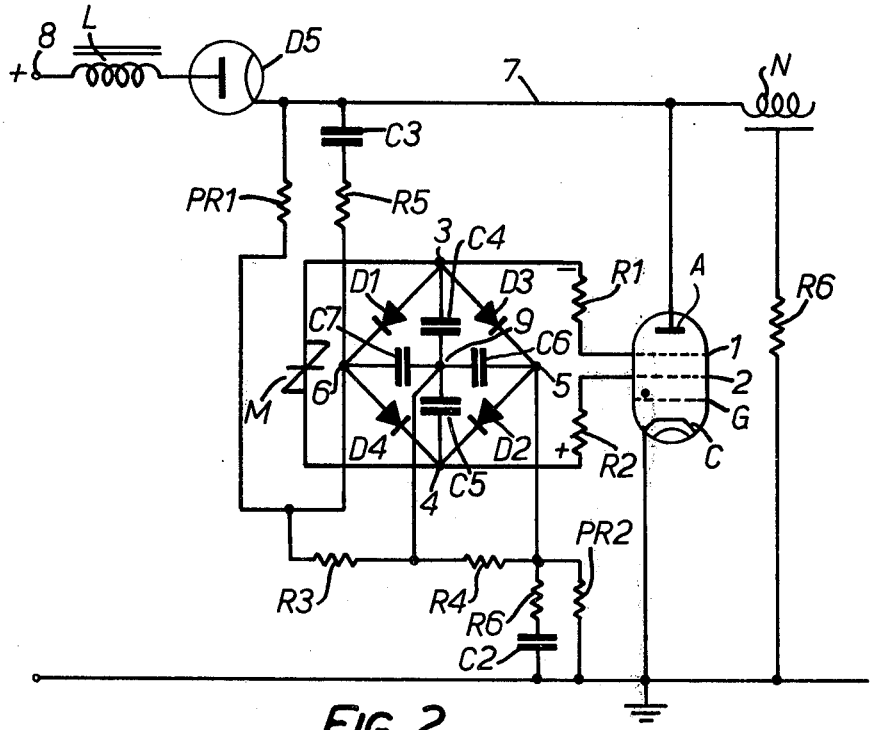

Referring to FIG. 2, in essence this is similar to the arrangement shown in FIG. 1, except that the normally provided gradient-grid potential divider chain is shown (consisting of resistors PR1 and PR2) and arrangements are made for the greater part of the current flowing through this divider chain to supplement that provided by the rectifying action described with reference to FIG. 1. In addition, attention is given in the arrangement of FIG. 2 to the protection of the rectifiers D1 to D4 from transient voltages which might otherwise damage these.

As will be seen, the capacitor C1 of FIG. 1 is replaced by a centre tapped capacitor arrangement consisting of two capacitors C4 and C5 extending between a common point 9 and the output terminals 3 and 4 of the bridge. Two voltage balancing resistors R3 and R4 are connected in series across the input terminals 5, 6 of the bridge and a connection is taken from between resistors R3 and R4 to common point 9. In addition, resistors R5 and R6 are provided between the capacitors C3 and C2 and the bridge rectifier circuit D1 to D4, and further capacitors C6, C7 are connected between the common point 9 and the input terminals 5, 6 of the bridge. These last mentioned resistors R5, R6 in association with capacitors C6, C7 serve to protect the diodes D1 to D4 against damage by voltage transients.

The charging action of the capacitors C4 and C5 is similar to that already described with reference to FIG. 1. It is the voltage across the series pair of capacitors C4 and C5 which is applied via the resistors R1 and R2 between the electrodes 1 and 2 of the gradient-grid pair of the thyratron T.

Figure 3:
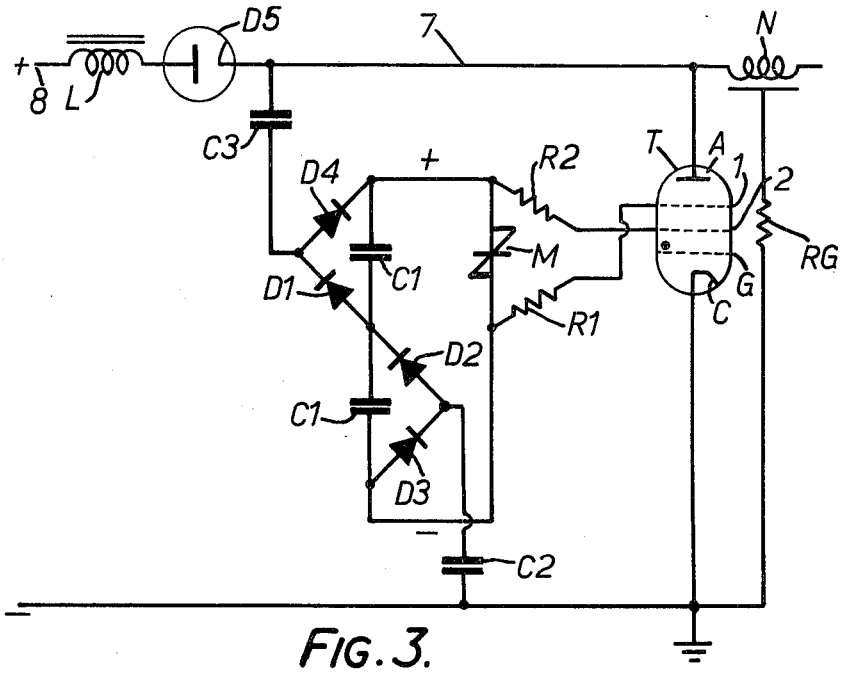
Figure 4:
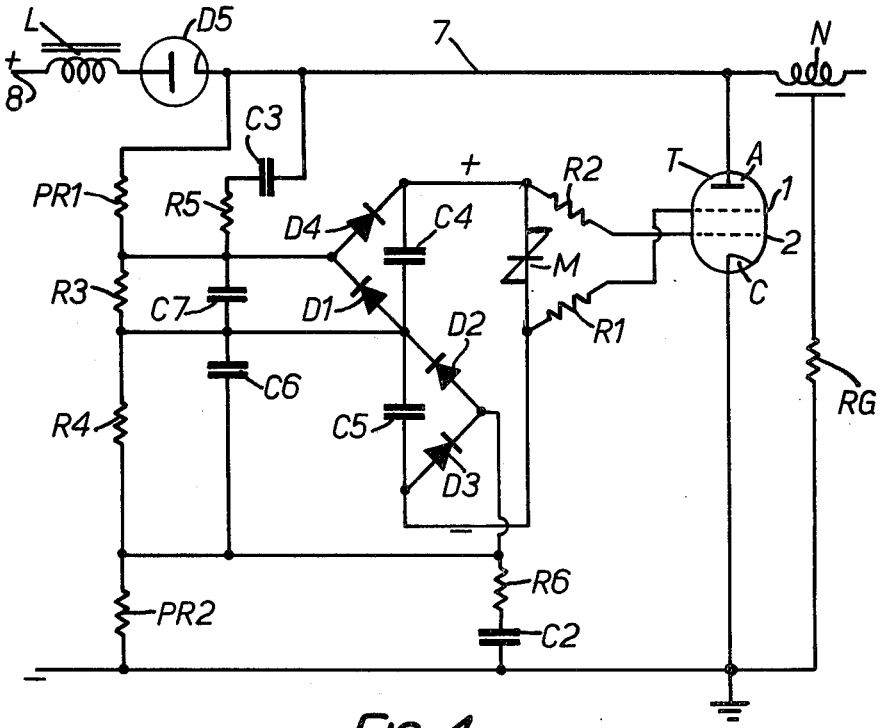

Referring to FIG. 3, this arrangement is equivalent to the arrangement shown in FIG. 1 except that the rectifier bridge circuit of FIG. 1 is provided in so called "split bridge" configuration, which provides twice the voltage at half the current compared with the bridge circuit shown in FIG. 1. For further information concerning such "split bridge" circuits reference may be made to the specification of U.K. Pat. No. 1,214,464.

Referring to FIG. 4, this again features a "split bridge" rectifier circuit and is the equivalent of the "protected" arrangement of FIG. 2 and, like the arrangement of FIG. 2, incorporates a tapping from the potential divider chain PR1 and PR2 in order to supplement the current provided for charging the capacitors by the rectifying action of the diodes D1 to D4. As in the case of FIG. 2, resistors R3 and R4 serve to balance the voltages occurring across capacitors C4 and C5.

In a modification, resistors R1 and R2 are replaced by inductors or a combination of inductors and resistors. Since current then builds up in the inductors during discharge, this current becomes available to assist in the clean-up of plasma between electrodes 1 and 2 when said discharge is over.

I claim:

1. A multi-gap thyratron arrangement comprising a thyratron having at least one gradient-grid pair consisting of two adjacent electrodes between the cathode and anode of said thyratron and means for constantly biassing that electrode of said gradient-grid pair which is nearer the anode negatively with respect to the other electrode of said gradient-grid pair.

2. An arrangement as claimed in claim 1 and wherein said means for biasing comprises a charge storage device connected between the two electrodes of a gradient-grid pair.

3. An arrangement as claimed in claim 2 and wherein said charge storage device is a capacitor.

4. An arrangement as claimed in claim 2 and wherein means are provided for rectifying a current derived from the fluctuating voltage appearing in operation across said thyratron as a result of said thyratron firing, to provide a source of charging current for said charge storage device.

5. An arrangement as claimed in claim 4 and wherein said rectifier means comprises a rectifier bridge circuit.

6. An arrangement as claimed in claim 5 and wherein a capacitor is connected across the output terminals of a quadrilateral rectifier bridge circuit, whilst the input terminals of said bridge circuit are connected each via a further capacitor to the anode and cathode respectively of said thyratron.

7. An arrangement as claimed in claim 5 and wherein four individual capacitors extend from a common point to the four terminals of a quadrilateral rectifier bridge circuit, the two output terminals being connected each to one of a pair of electrodes forming a gradient-grid pair and the two input terminals being connected via further capacitors one to the anode and the other to the cathode of said thyratron, and a connection is provided between said common point and the junction point of two voltage balancing resistors extending between said input terminals of said bridge.

8. An arrangement as claimed in claim 6 and wherein that the greater part of the current flowing in operation through a potential divider chain connected across said thyratron is applied to the input terminals of said rectifier bridge circuit in order to supplement the current flowing through said further capacitors to charge said charge storage device.

9. An arrangement as claimed in claim 6 and wherein between each further capacitor and the respective corner of said rectifier bridge a resistor is provided.

10. An arrangement as claimed in claim 5 and wherein said rectifier bridge circuit is provided in "split bridge " configuration.

11. An arrangement as claimed in claim 2 and wherein in all cases across the charge storage device biassing that electrode of a gradient-grid pair which is nearer said anode negatively with respect to the other electrode of said gradient-grid pair, a voltage stabilising device is provided in order to limit the voltage to which said charge storage device may charge.

12. A multi-gap thyratron arrangement comprising in combination:

a thyratron having a cathode and an anode spaced therefrom, and at least one gradient-grid pair consisting of a first electrode and a second electrode spaced therefrom, said electrodes being disposed in the space between said cathode and said anode with said first electrode being disposed more closely to said anode than is said second electrode;

pulse-forming network means associated with said thyratron for causing the voltage across said thyratron to rise sinusoidally from zero to a maximum and then, after a short delay, to fall suddenly back to zero as the thyratron fires, said network means including a cathode rail connected to said cathode and an anode rail connected to said anode;

rectifier means connected across said rails and including a charge storing device for accumulating and continuously maintaining a first junction of said rectifier means at a potential which is negative with respect to a second junction of said rectifier means in response to the voltage across said thyratron; and said first junction being connected to said first electrode and said second junction being connected to said second electrode whereby said first electrode is constantly biassed negatively with respect to said second electrode thereby tending to prevent the passage of electrons into the space between said first electrode and said anode as the plasma present between said electrodes decays.

13. A multi-gap thyratron arrangement as defined in claim 12 wherein said rectifier means comprises a first pair of diodes connected in series and poled identically across said rails, said charge forming device comprising a capacitor connected in series between said diodes and forming respectively therewith said first and second junctions.

14. A multi-gap thyratron arrangement as defined in claim 13 wherein said rectifier means comprises a second pair of diodes connected in series and poled identically across said rails, the second pair of diodes being poled oppositely with respect to said first pair of diodes and the four diodes of said first and second pairs being connected as a bridge circuit.

15. A multi-gap thyratron arrangement as defined in claim 14 wherein said rectifier means further comprises a first capacitor connected in series between said bridge circuit and said anode rail and a second capacitor connected in series between said bridge circuit and said cathode rail.

16. A multi-gap thyratron arrangement as defined in claim 13 including means connected across said first and second junctions for limiting the voltage across said capacitor to a predetermined value.

17. A multi-gap thyratron arrangement comprising a thyratron having at least one gradient-grid pair consisting of two adjacent electrodes between the cathode and anode of the thyratron, and means for constantly biassing that one electrode of said gradient-grid pair which is nearer the anode sufficiently negative with respect to the other electrode of said gradient-grid pair as tends to prevent the passage of electrons into the space between said one electrode and said anode as the plasma present between said electrodes decays.

* * * * *